US011479998B1

(12) United States Patent
Levy

(10) Patent No.: US 11,479,998 B1
(45) Date of Patent: Oct. 25, 2022

(54) ADJUSTABLE DOOR HINGE

(71) Applicant: Peter L. Levy, San Francisco, CA (US)

(72) Inventor: Peter L. Levy, San Francisco, CA (US)

( * ) Notice: Subject to any disclaimer, the term of this patent is extended or adjusted under 35 U.S.C. 154(b) by 39 days.

(21) Appl. No.: 17/525,062

(22) Filed: Nov. 12, 2021

(51) Int. Cl.
*E05D 7/04* (2006.01)

(52) U.S. Cl.
CPC .... *E05D 7/0423* (2013.01); *E05D 2007/0469* (2013.01); *E05D 2007/0484* (2013.01); *E05Y 2900/132* (2013.01)

(58) Field of Classification Search
CPC ..... Y10T 16/5321; Y10T 16/5322; Y10T 16/53225; Y10T 16/53253; Y10T 16/5326; Y10T 16/5327; E05D 7/0423; E05D 7/0425; E05D 2007/0469; E05D 2007/0484; E05D 2900/132
See application file for complete search history.

(56) References Cited

U.S. PATENT DOCUMENTS 516,546 A * 3/1894 McCauley ..... E05D 11/082 16/338
2,532,772 A * 12/1950 Kamfjord ..... E05D 7/0027 16/248
2,779,966 A * 2/1957 Torchia ..... E05D 7/0027 16/244
3,178,762 A * 4/1965 Whiting ..... E05D 11/06 16/375
3,621,512 A * 11/1971 Johnson ..... E05D 5/128 16/380
5,201,097 A * 4/1993 Phillips ..... E05D 7/0027 16/243
5,711,053 A * 1/1998 Hafner ..... E05D 5/128 16/380
5,966,778 A * 10/1999 Ray ..... E05D 11/082 16/262
7,603,746 B1 * 10/2009 von Resch ..... E05D 7/0054 16/238
8,732,906 B1 * 5/2014 Van Gennep ..... E05D 11/1007 16/229
9,546,509 B2 * 1/2017 Siekierka ..... E05D 5/0246
2004/0093689 A1 * 5/2004 Sosa ..... E05D 7/04 16/301
2009/0089974 A1 * 4/2009 Fries ..... E05D 7/0415 16/243
2013/0333160 A1 * 12/2013 Ochs ..... E05D 7/0009 16/236
2014/0259527 A1 * 9/2014 Chung ..... E05D 7/0415 16/238
2019/0003224 A1 * 1/2019 Reuter ..... E05D 7/081
2019/0186186 A1 * 6/2019 Tamer ..... E05D 11/1007

FOREIGN PATENT DOCUMENTS

JP 08028130 A * 1/1996
JP 09177416 A * 7/1997
JP 2000017930 A * 1/2000
JP 2014218793 A * 11/2014
KR 101432068 B1 * 8/2014

* cited by examiner

*Primary Examiner* — Chuck Y Mah
(74) *Attorney, Agent, or Firm* — Walt Froloff

(57) ABSTRACT

An adjustable door hinge having asymmetric leaves, one leaf on the door plane and a gap between leaf knuckles for vertical adjusting crescent disc shims and a leaf having a slot for positioning a fastener along the slot for lateral adjustments.

10 Claims, 6 Drawing Sheets

ADJUSTABLE DOOR HINGE

BACKGROUND

Field of the Invention

The present invention relates generally to improvements in door hinges and specifically to adjustable door hinges.

Background of the Invention

New door installations and newly hung doors introduce fitting into the existing door jam or door frame problems, such that the door is not free to swing open and or closed without obstruction, being out of alignment with the door-jam. A new door is not guaranteed to fit an old door frame due to a jamb being out of vertical or horizontal alignment. Or, the problem may be caused from friction between the door edge and surrounding frame making the hinge mortise too deep which creates an uneven gap between the door and frame along the latch side of the door as well as corner points on the door and frame that are out of registration.

Generally such problems are solved by shimming a hinge or two with a cut piece of cardboard, thin flooring scrap, or in some cases a shim cut out to fit behind of the hinge in its mount to the door or the frame mounting surface. Testing for correct fit between the door and frame is accomplished by closing the door and checking the gaps. If the door sticks at the top hinge, it may be rectified by shimming the top hinge and de-snagging the bottom hinge, and vice versa for a door sticking at the bottom hinge. If the door sticks at the top knob-side corner, tightening the top hinge and shimming the bottom hinge may solve the problem, and vice versa for a door sticking at the bottom knob-side corner. Shimming is inexact, trial and error process and cam become a time consuming and frustrating process requiring the repeated removal and re-installation of a hinge and door Such adjustments require mounting the door and visually noting how much the door gap changed and re-shim the hinge just adjusted or shim other hinges accordingly if necessary. A related problem in this process is the fact that shimming out too thick as to make the shim visible, not a fashionable look to say the least.

Additional problems with the fit and unobstructed rotation of doors on their hinges are caused in older buildings or door installations where the door frames tend to be out of square from the setting of the building on its foundation, or the swelling or shrinking of the frame over time from moisture and humidity affecting the frame itself.

On such a door replacement, removing the screws mounting the hinges to the frame or the door can be fraught problems of stripping of the screw within its mount in the door or frame which may cause the additional problem that must be corrected. Consequently the removal of screws from hinges on older door jams to allow for shimming or readjustment of the hinge mounts is also problematic, as each such re-installation creates the additional problem for a stripped screw mounting or worse.

Current, the most likely scenario it to purchase a new door frame with the new door, increasing both the cost of the replacement and the cost of installation minus the angst and frustration.

What is needed is a device that would alleviate the need for shimming on newly mounted doors or old doors in need of replacement. What is needed is a door hinge that would reduce the potential for stripping the mount of the screws to the door or frame from the repeated removal and reinstallation of the screws when door clearance adjustments are required. Such a hinge should be easily adjustable without the need to remove any of the screws or hinge disassembly. What is need is a hinge device which allows for door shrinkage an expansion from age and moisture respectively.

What is needed are door hinge solution which would not complicate arrangement of the hinge or increase cost and which not easily user adjustable when the door is re-installed or re-mounted. What is needed are door hinge solution which would be useable with the vast majority of entry doors for the residential and commercial rooms and buildings.

What is needed are door hinge solutions where adjustment are not difficult in attached door location should the weight of the door jam a bushing, especially prevalent in older doors that have been hanging long enough to develop door sag for any reason present an unreasonably expensive solution.

What is needed is an easily and inexpensively manufactured hinge that will function with conventional entry doors and provide adjustment of such doors inside their frames. Such a hinge should provide for easy adjustment of both newly hung doors and doors having been hanging for many years. Such a device should be easy to mechanically adjust from the exterior of the hinge and should bear the majority of weight of the hung door in such a manner so as not to bind the adjustment components when the door weight is imparted to the hinge.

SUMMARY

The present invention discloses an adjustable door hinge having two hinge plate leaves coupled by a pin axially disposed centerline through the knuckles. The knuckle pin extends through and beyond the knuckle and has a pin length adjustable screw cap. A first hinge plate leaf is disposed along a door plane, the first hinge plate leaf having a slot with notches demarking fastener positioning stations with markings for positioning a fastener along the slot and at least one hole in the hinge plate leaf for a fastener coupling the first hinge leaf to the door along the door plane. A second hinge plate leaf is disposed in the door frame plane, the second hinge plate leaf has at least two holes for fastening the second hinge plate leaf to the door frame. For elevation adjusting a door a crescent shim disc is force fit onto an exposed pin having an knuckle gap between the plate leaves, with an extended pin length for accommodating a knuckle gap for insertion of a crescent shaped disc shim. Thus a door can by elevated by slightly lifting the door and exposing the pin in a knuckle gap between the plates and inserting one or more crescent shaped shim disc onto the exposed pin in the knuckle gap providing the crescent disc thickness length relative to the door frame, by lifting the first hinge plate leaf an inserted disc(s) thickness and accommodating a lateral shift of the door through a repositioning of an fastener in the $2^{nd}$ leaf slot.

The slot in the $2^{nd}$ leaf can be a more-or-less rectangular slot with gear teeth sleeve engaging a slot along the upper and lower slot gear racks coupled to a door anchoring fastener with a gear sleeve respectively and a gear engaging the slot upper and lower gear racks respectively, confined and engaged in the slot plane.

BRIEF DESCRIPTION OF DRAWINGS

Specific embodiments of the invention will be described in detail with reference to the following figures.

DETAILED DESCRIPTION

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Objects and Advantages

An object of the invention that will provide an inexpensively manufactured hinge that will function with conventional entry doors and provide adjustment of such doors inside their frames.

Another object of the invention is provide for easy adjustment of both newly hung doors and doors having been hanging for many years.

Yet another object of the invention would be to provide a door hinge which is easy to mechanically adjust from the exterior of the hinge and should bear the majority of weight of the hung door in such a manner so as not to bind the adjustment components when the door weight is imparted to the hinge.

Yet still another objective of the invention is to create door hinge solutions where adjustment are not difficult in attached door location should the weight of the door jam a bushing, especially prevalent in older doors that have been hanging long enough to develop door sag for any reason present an unreasonably expensive solution.

Another object of the invention is to create a hinge to alleviate the need for shimming on newly mounted doors or old doors in need of replacement.

Yet another object of the invention is a door hinge that would reduce the potential for stripping the mount of the screws to the door or frame from the repeated removal and reinstallation of the screws when door clearance adjustments are required.

The present invention discloses several embodiments for making a door hinge to relieve some of the deficits cited above with previous door hinge designs. Furthermore in an aspect of the invention, material other than metal and metal alloys can be used, as are plastics and composite materials.

Yet another object of the invention is to create a device that would alleviate the need for shimming on newly mounted doors or old doors in need of replacement.

Another object of the invention is a door hinge that would reduce the potential for stripping the mount of the screws to the door or frame from the repeated removal and reinstallation of the screws when door clearance adjustments are required.

Figure Details

Figure 1:
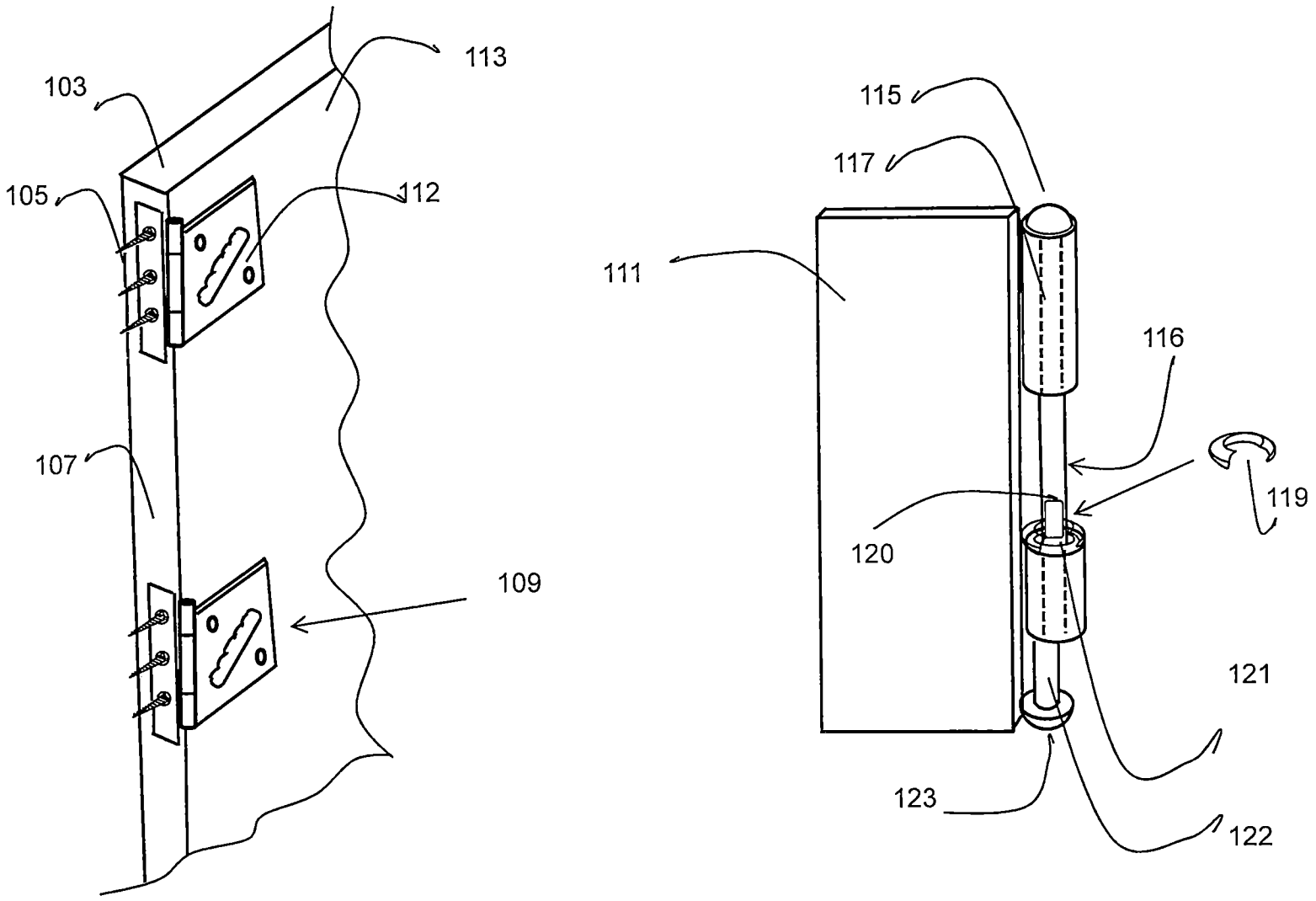
FIG. 1 illustrates an adjustable two leaf door hinge 109 with a variable knuckle gap in an embodiment of the invention.

FIG. 1 illustrates an adjustable two leaf door hinge 109 with a variable knuckle gap in an embodiment of the invention. A door 103, is coupled to the door frame with fasteners 105 through the door jam plane leaf 111 positioned in the door jam or door frame plane 107. The leaf is pivotal to and extends laterally coupled to a knuckle 117. A second hinge leaf 112 coupled to a door in a door plane 112 is coupled to the door 103 along the door plane 113. Each door jam hinge leaf 111 is coupled to a knuckle 117 having a pin 120 extending through the knuckle beyond the hinge length 121, generally with an adjustable cap 123 to insure pin stability. Crescent disc shims 119 are installed into a pin knuckle gap 116 onto the pin 120 by slightly lifting elevating the leaf coupled door 103, opening a gap 116 and lightly force fitting a crescent disc shim(s) 119 between knuckles 117 121. An extended pin length 122 accommodates adjusting the knuckle gap 116 for insertion of at least one crescent shaped disc shim 119 onto the pin 120. Any axial movement between the two leaves or plates along the axis of the pin remains adjustable because knuckle separation provides freedom for the leaves to rotate without binding and is determined by the typical distance between the knuckle gap when both edges of the leaves are aligned with the crescent disc shims. The number of hinges 109 on a door can be as many as desired placing an equal number of adjustment discs 119 between the plate flanges as needed to distribute the door load evenly across multiple hinges 109.

Figure 2:
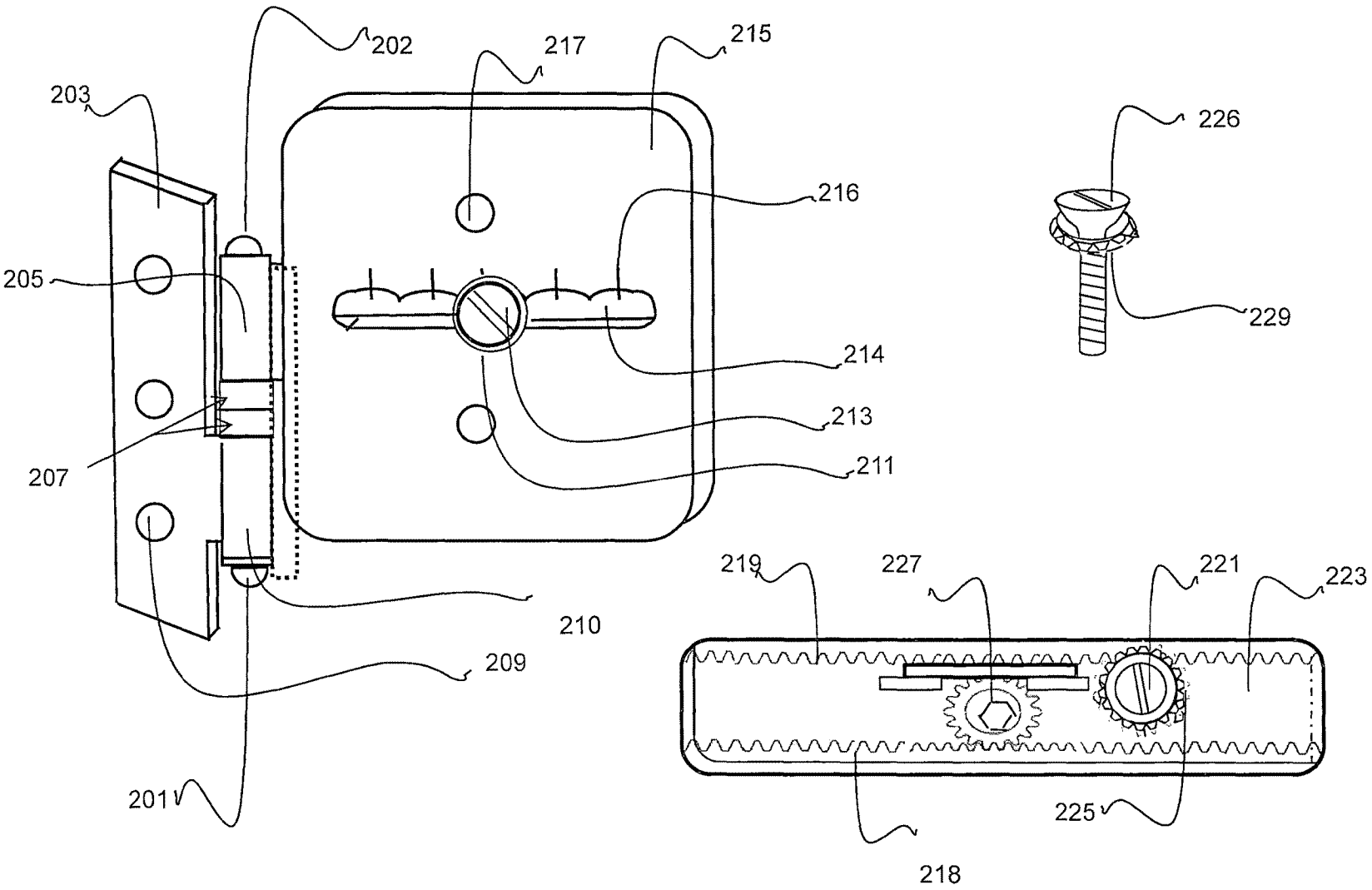
FIG. 2 shows a detailed illustration of the two asymmetric leaf hinges 215 with a slot for lateral door adjustment on one leaf in an embodiment of the invention.

FIG. 2 shows a detailed illustration of the two asymmetric leaf hinges 203 215 with a slot 214 223 for lateral door adjustment on one leaf 215 in embodiments of the invention. Two hinge leaves or plates 203 215 of disparate leaf dimensions are coupled by knuckles 205 210 having a pin 202 axially disposed centerline in the knuckles 205 210 allowing the leaves to pivot or swing with the door opening and closing. The knuckle pin 202 has an adjustable screw cap 201 end to accommodate widening a gap between the two leaf knuckles 205 210. A door hinge leaf 215 is disposed along a door plane, the hinge leaf 215 has a slot 214 223 with notches 216 demarking fastener 213 221 positioning stations with markings 216 219 for placing a fastener 213 221 along the slot 214 223 respectively, the leaf has at least one hole 217 to anchor the leaf adjacent to the slot 214 221 and in the hinge plate 215 for a fastener 213 221 coupling the door hinge plate 215 to the door along a door plane. A door jam or second hinge leaf 203 is disposed in the door frame or jam plane, this hinge plate 203 of less than door frame width and having at least two holes 209 for fastening the door jam hinge leaf to the door frame. At least one crescent disc shim 207 is force fit onto the pin 202 at an exposed knuckle gap between the knuckles 205 210. The hinge length and also the sum of the knuckle individual lengths are therefore by design less than the pin 202 length. A fastener sleeve 211 229 225 may be used with a leaf fastener 213 226 221 respectively so that fitting a door into a frame can accommodate lateral movement and resist the fastener fatiguing the door material from repeated adjustment.

In an embodiment a more-or-less rectangular slot 223 with gear teeth 225 229 sleeve engaging a slot along the upper and lower slot gear racks coupled to a door anchoring fastener 221 226 with a gear sleeve 225 229 respectively and a gear 227 engaging the slot upper and lower gear racks 219 218 respectively and confined in the slot 223 and engaged with the slot upper and lower gear racks 219 218 respectively. Thus to mechanically adjust from the exterior of the hinge majority of weight of the hung door which may have developed sag, is leveraged from a gear 227 turning and doesn't bind the adjustment components when the door weight is on the hinge. Moreover, this would reduce the potential for stripping the mount of the screws to the door or frame from the repeated removal and reinstallation of the screws when door clearance adjustments can be made by mechanically shifting by gear.

Figure 3:
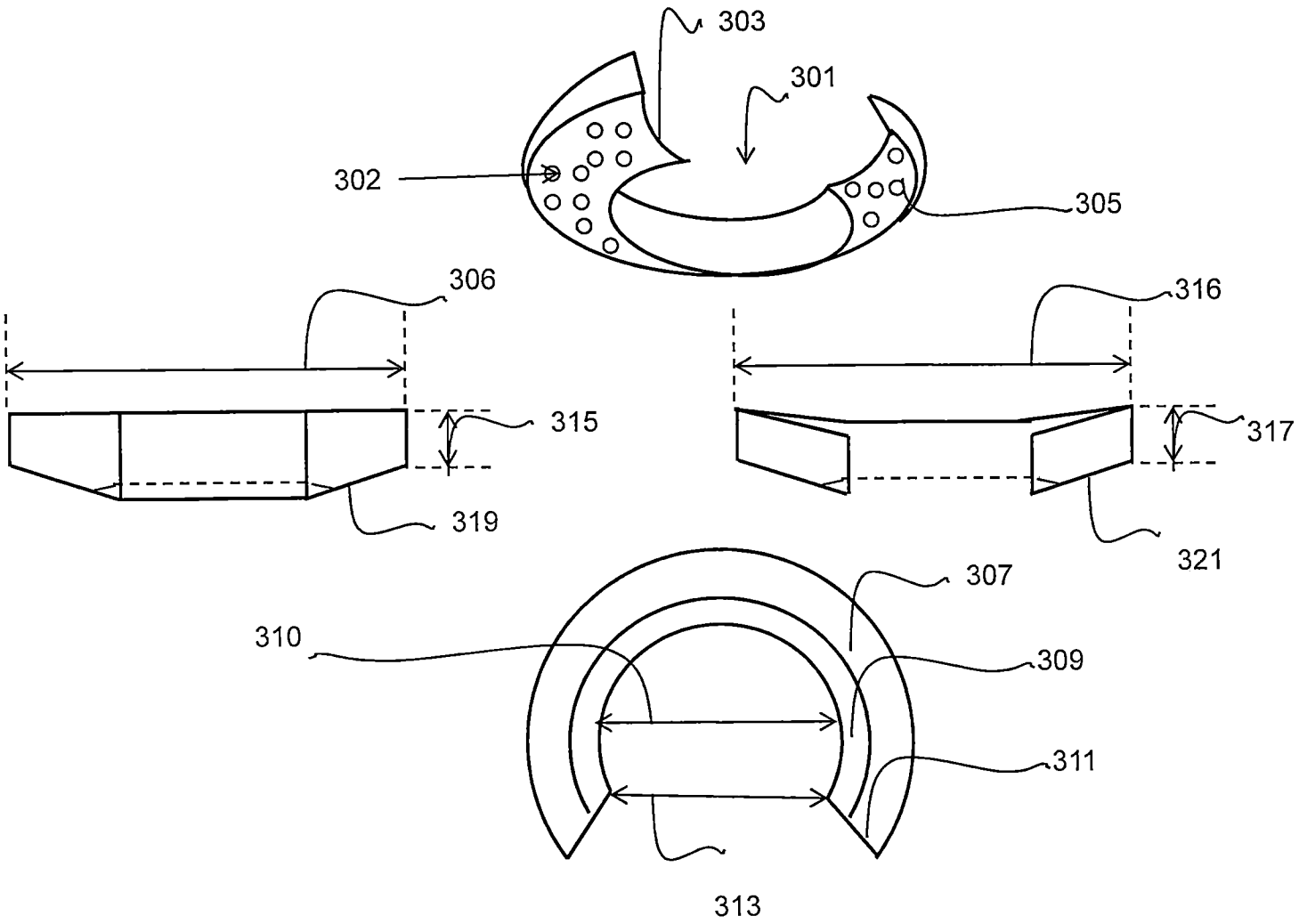
FIG. 3 Top, side and perspective views of crescent disc shims for door elevation are shown in an aspect of the invention.

FIG. 3 Top, side and perspective views of crescent disc shims for door elevation are shown in an aspect of the invention. A typical outside diameter 306 316 of a crescent disc shim 301 is equal to or slightly greater than the complementing knuckle outside diameter. The crescent disc shim inside diameter is approximately the same as the beveled or beveled-recessed knuckle inside diameter 310 of the protruding flange or knuckle of a door hinge plate leaf. In some embodiments the contact surface 302 of the disc to a knuckle could also have a low friction coating or lubricant like graphite to reduce friction at hinge pivoting. In another embodiment a slight curvature or bevel 305 309 319 321 on one or more crescent disc shims to provide fitting more disc shims of alternate but pre-set thicknesses 315 317 to be placed either between the discs or also between top portion of plate flange or knuckle and adjoining crescent disc 301. The hinges and crescent discs could be made of corrosion proof materials to prevent rust or oxidation. In other embodiments where metal is not desired, the crescent discs could be made out of non-metallic substances, such as plastic or any tough hard polymer. A crescent disc opening 313 is less than the disc inside diameter but less than the pin outside diameter with edge angle 303 311 and provides sufficient negative clearance or interference to require a tap to push fit the disc onto a hinge pin followed by a drop into the recessed knuckle.

Figure 4:
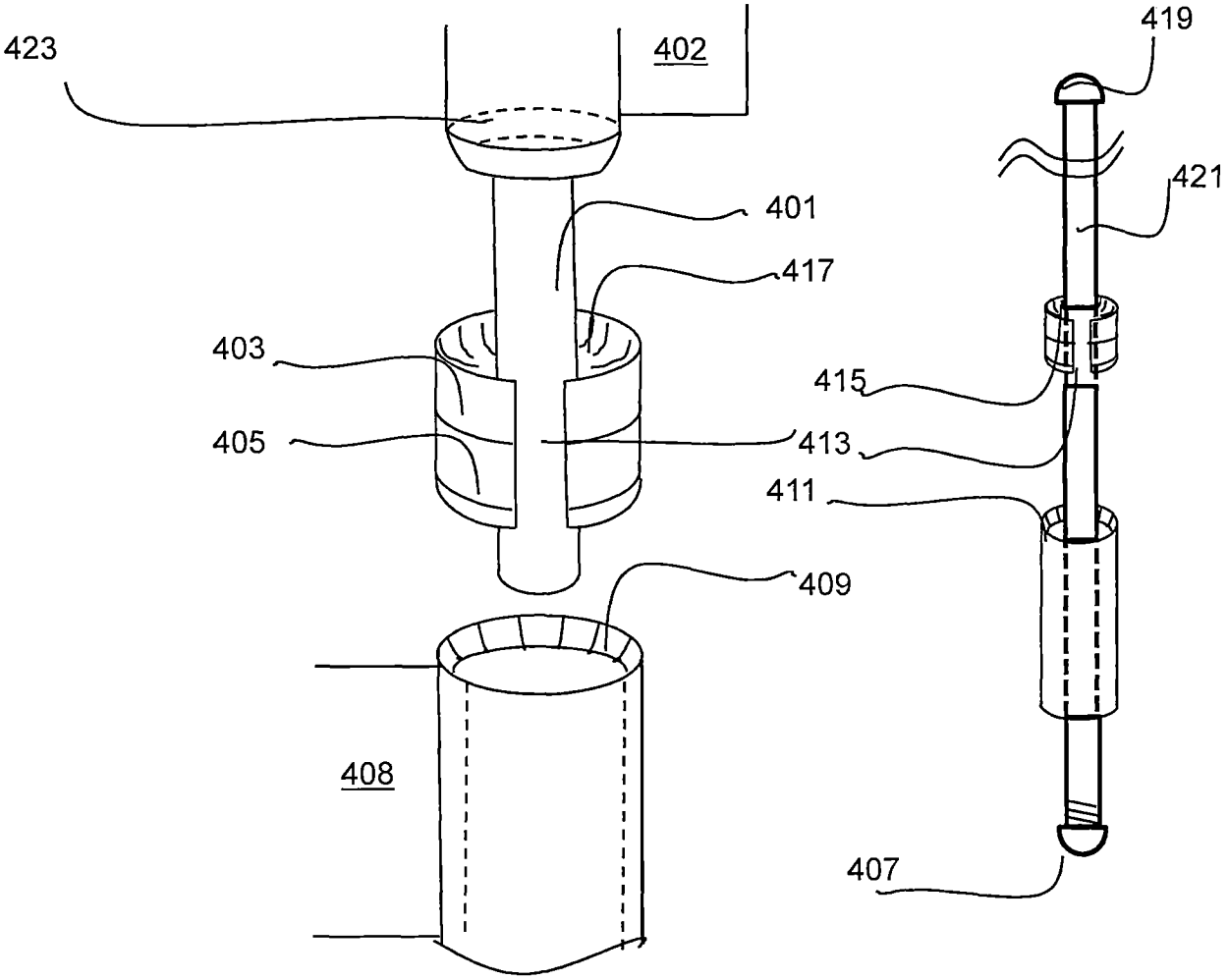
FIG. 4 shows crescent disc shim placement between a recessed and a beveled knuckle in an embodiment of the invention.

FIG. 4 shows crescent disc shim placement between a recessed and a beveled knuckle in an embodiment of the invention. A beveled knuckle 423 will generally mate with a recessed knuckle 409 411. A hinge will have a pin 401 421 and a cap 419 on one end and an screw adjustable pin cap 407 on the other end, coupling beveled knuckle 423 with a hinge leaf 402 and a recessed knuckle 409 of the $2^{nd}$ or complementing hinge leaf 408. A recessed/beveled crescent disc 403 can be fit snuggly with another recessed/beveled crescent disc 405 or more to add door elevation as needed. Recessed, beveled or flat, this would alleviate the need for shimming on newly mounted doors or old doors in need of replacement.

Figure 5:
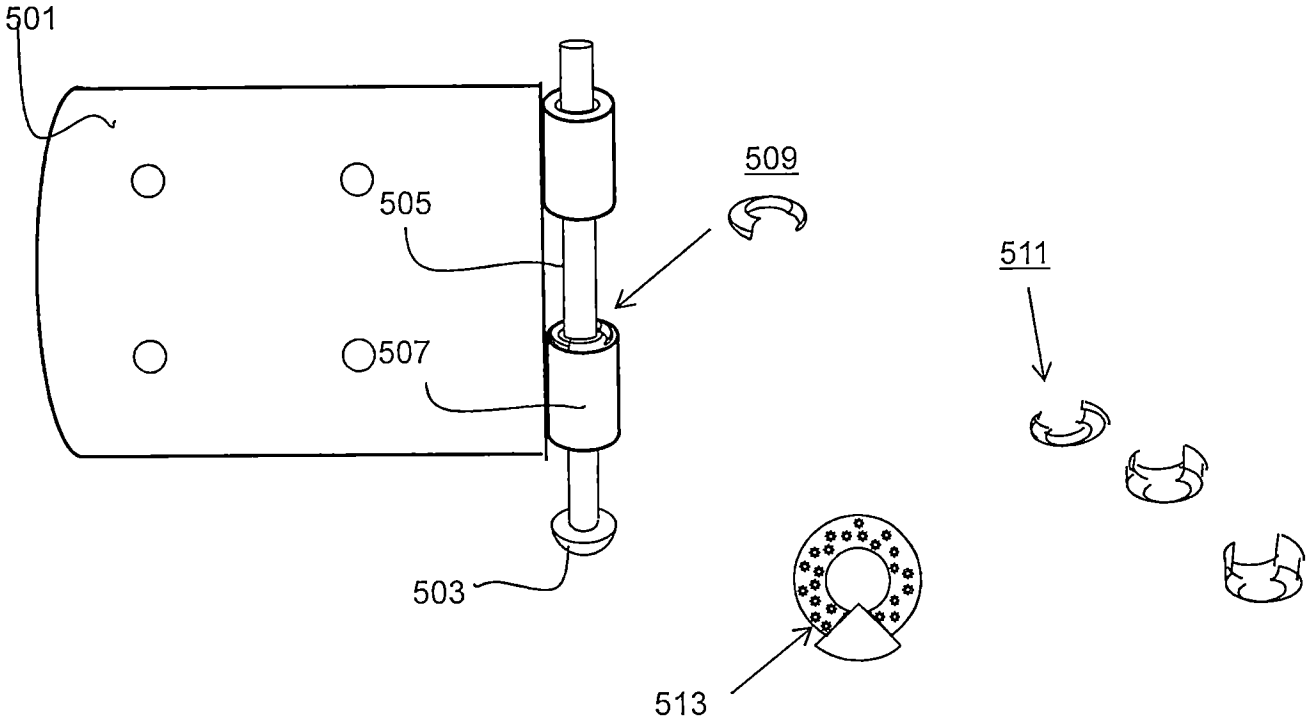
FIG. 5 illustrates multiple crescent disc shims at set thickness for variable hinge elevation adjustment in an embodiment of the invention.

FIG. 5 illustrates multiple crescent disc shims at set thickness for variable hinge elevation adjustment in an embodiment of the invention. A series or sets 511 of adjustment crescent discs for example $1/16^{th}$ inch, $1/8^{th}$ inch, $1/4^{th}$ inch and others can be placed 509 on hinge plate leaf flange 501 to adjust for a desired door height to fit snuggle in its door frame. In another embodiment, hinge rings can be press fit placed or removed by taking off the cap 503 and removing the hinge pin 505 for making desired disc thickness adjustment. Having discs of varying thickness 511 provides elevation adjustment by selecting a single crescent disc or multiple discs in series for press fitting onto the pin 505 and onto a knuckle, in some embodiments a recessed knuckle 507. In some embodiments disc thickness sets 511 are thin, for example $1/64^{th}$ or $1/32^{nd}$ of an inch to provide the needed fine incremental adjustment in door height. The disc material could be the same metal that the hinge leaves are made of to give uniformity of color but they could be made of any material that holds up to the wear of a door's repeated opening and closing. Self lubricating material or disc surface lubricant 512 can be used in some embodiments.

Figure 6:
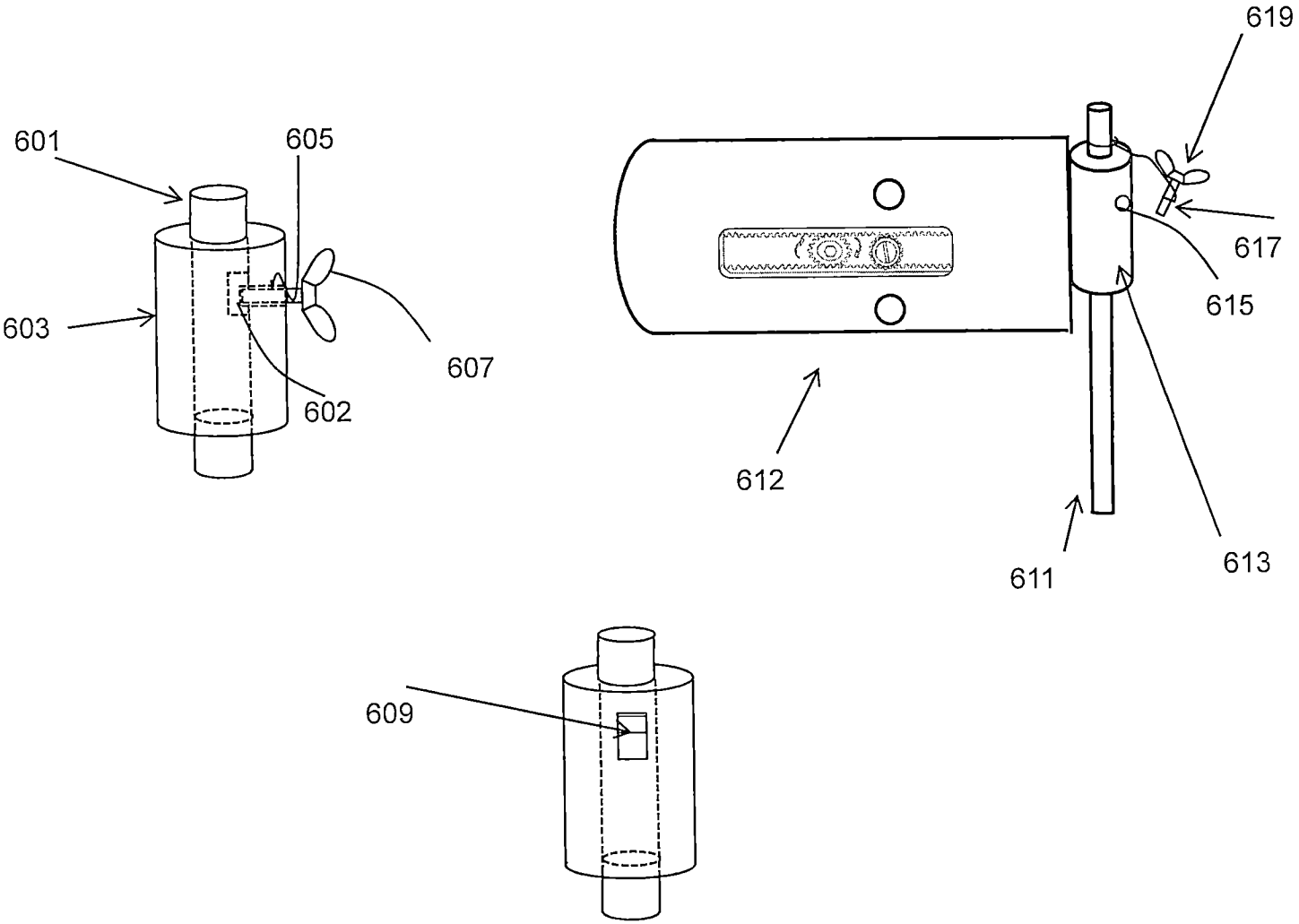
FIG. 6 illustrates an adjustable door hinge with a built in door stop in an embodiment of the invention.

FIG. 6 illustrates an adjustable door hinge with a built in door stop in an embodiment of the invention. A hinge pin 601 611 covered portion of a coupled hinge leaf 612 knuckle 613 603, the pin 601 611 having a detent or notch 603, a knuckle 603 615 with a penetration 602 615 for fitting a blunt screw 605 617 respectfully with a screw wingnut head 607 619. The wingnut head 607 619 can be hand tightened or loosened at a particular door plane angle. In some embodiments the notch 602 may be a latch 609 which for rigid engage and disengages a hinge pin 601. The wing screw 617 which is screwed into a knuckle 613 penetration 615 in hinge knuckle 613 can be attached to a wire looped around top part of hinge pin 611 so that if it comes undone it does not fall out but hangs on pin 611 until it can be used as a door stop.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. An adjustable door hinge comprising:

two hinge plates coupled by at least one knuckle having a pin axially disposed centerline in the knuckle;

the knuckle pin extending through and beyond the knuckle and having a pin length adjustable screw cap;

a first of the two hinge plate leafs disposed along a door plane, the first hinge plate leaf having a slot with notches for a demarking slot fastener positioning stations with markings for positioning a slot fastener along the slot and at least one hole in the hinge plate leaf for a first hinge leaf fastener coupling the first hinge leaf to the door along the door plane;

the second of the two hinge plate leafs disposed in the door frame plane, the second hinge plate leaf having at least two holes for fastening at least two fasteners to the second hinge plate leaf to the door frame;

at least one crescent shim disc force fit onto the pin having knuckle gap between the plate leaves, and an extended pin length for accommodating a knuckle gap for insertion of at least one crescent shaped disc shim, whereby a door can be elevated by slightly lifting the door and exposing the pin in a knuckle gap between the plates and inserting one or more crescent shaped shim disc onto the pin in the knuckle gap providing adjusting elevation from the crescent disc thickness length relative to the door frame, by lifting the first hinge plate leaf an inserted disc(s) thickness and accommodating a lateral shift of the door through a repositioning of slot fastener in the first hinge plate leaf slot.

2. An adjustable door hinge as in claim 1 wherein a series adjustment crescent discs thickness shims are provided.

3. An adjustable door hinge as in claim 1 further comprising recessed knuckles for mating with beveled shim discs on the pin.

4. An adjustable door hinge as in claim 1 further comprising knuckle penetrations extending to a centerline pin for accommodating winged head screws.

5. An adjustable door hinge as in claim 1 further comprising a slot with gear racks coupled to a slot fastener with a gear sleeve engaging the slot gear rack confined in the slot with an anchored gear coupled to the slot gear rack confined and teeth engaged in the slot plane.

6. A method for an adjustable door hinge as in claim 1 further comprising the steps of providing a slot with gear racks coupled to a slot fastener with a gear sleeve engaging the slot gear rack confined in the slot with an anchored gear coupled to the slot gear rack confined and gear rack engaged in the slot.

7. A method for an adjustable door hinge comprising the steps of:

providing two hinge plates coupled by at least one knuckle having a pin axially disposed centerline in the knuckle;

extending the knuckle pin through and beyond the knuckle and having an adjustable screw cap end;

providing a first of the two hinge plate disposed along a door plane, the first hinge plate having a slot with notches fora demarking slot fastener anchoring stations with markings for metering along the slot and at least one hole in the hinge plate for a first hinge leaf fastener coupling the first hinge to the door along the door plane;

providing a second hinge plate leafs disposed in the door frame plane, the second of the two hinge plate having at least two holes for fastening at least two fasteners to the second hinge plate to the door frame;

force fitting at least one crescent shim disc onto a knuckle gap between the plates leaving, and accommodating the knuckle gap for insertion of at least one crescent shaped disc shim, whereby a door can by elevated by slightly lifting the door and exposing the pin through a knuckle gap between the plates and inserting one or more crescent shaped shim disc onto the exposed pin in the knuckle gap providing the crescent disc length relative to the door frame lift, by lifting the first hinge plate an inserted disc(s) thickness and or accommodating a lateral door frame adjustment by shift of the door through a repositioning of an fastener in the first hinge plate leaf slot.

8. A method for an adjustable door hinge as in claim 7 further comprising the steps of providing a series of adjustment crescent disc shims to adjust a door elevation.

9. A method for an adjustable door hinge as in claim 7 further comprising the steps of providing recessed knuckle ends for mating with beveled shim discs on the pin.

10. A method for an adjustable door hinge as in claim 7 further comprising the steps of providing knuckle penetrations extending to a centerline pin for accommodating winged head screws.

* * * * *